US006379233B1

(12) United States Patent
Kobayashi et al.

(10) Patent No.: US 6,379,233 B1
(45) **Date of Patent: *Apr. 30, 2002**

(54) SPIRAL-FLOW BARREL FINISHING MACHINE WITH GAP ADJUSTING FUNCTION

(75) Inventors: Fumiaki Kobayashi; Katsuhiro Izuhara; Akihito Fujishiro, all of Nagoya (JP)

(73) Assignee: Tipton Corp., Aichi (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/014,605

(22) Filed: Jan. 28, 1998

(30) Foreign Application Priority Data

Jan. 31, 1997 (JP) ..... 9-018553
Aug. 11, 1997 (JP) ..... 9-216785

(51) Int. Cl.[7] ..... B24B 31/00
(52) U.S. Cl. ..... 451/326; 451/327; 451/328
(58) Field of Search ..... 451/74, 32, 113, 451/117, 104, 326, 327, 328, 329, 330

(56) References Cited

U.S. PATENT DOCUMENTS

| | | | | | |
|---|---|---|---|---|---|
| 4,096,666 | A | * | 6/1978 | Brown | 51/7 |
| 4,939,871 | A | * | 7/1990 | Ditscherlein | 51/163.2 |
| 5,012,620 | A | * | 5/1991 | McNeil | 51/313 |
| 5,119,597 | A | * | 6/1992 | Davidson | 51/163.1 |
| 5,189,842 | A | * | 3/1993 | Kobayashi et al. | 51/163.1 |
| 5,211,673 | A | * | 5/1993 | Ditscherlein | 51/163.2 |
| 5,476,415 | A | * | 12/1995 | Nishimura et al. | 451/326 |
| 5,823,861 | A | * | 10/1998 | Kobayashi et al. | 451/326 |

* cited by examiner

*Primary Examiner*—Timothy V. Eley
*Assistant Examiner*—Dung Van Nguyen

(57) ABSTRACT

A spiral-flow barrel finishing machine having a cylindrical stationary barrel and a rotary barrel closed at the bottom thereof includes an escape layer or air layer provided between an inner side of a metallic wall of the stationary barrel and an outer side of a lining layer being formed thereon for allowing for outward thermal expansion of the lining layer. The escape layer is provided over a specific area between the inner side of the metallic wall of the stationary barrel and the outer side of the lining layer formed thereon.

3 Claims, 8 Drawing Sheets

SPIRAL-FLOW BARREL FINISHING MACHINE WITH GAP ADJUSTING FUNCTION

FIELD OF THE INVENTION

The present invention relates generally to a spiral-flow barrel finishing machine comprising a cylindrical stationary metallic barrel equipped with a lining layer at a lower inside part and a rotating barrel which is equipped with a lining layer on a metallic rotational body and loosely engaged with the lower part inside of the cylindrical stationary barrel so s to rotate freely. More particularly, the present invention relates to such a machine including a gap adjusting function that provides an escape layer (such as an air layer) between the inner side of the metallic wall of the stationary barrel and the outer side of the lining layer provided on the metallic wall to allow for the lining layer to thermally expand outwardly and keep the rotary barrel spaced away from the stationary barrel opposite it, regardless of whether the lining layer expands or not. The present invention also includes a method of providing the escape layer and a method of adjusting the gap between the stationary barrel and the rotary barrel.

DESCRIPTION OF THE PRIOR ART

As shown in FIG. 11, when workpieces are processed by a spiral-flow barrel finishing machine 15 which is running continuously for a long time, the temperature within stationary and rotary barrels 4, 12 is rising, or water is absorbed by respective lining layers 3, 14 on the stationary and rotary barrels 4, 12. In either case, the lining layer 14 on the rotary barrel 12 may expand outwardly, and the lining layer 3 on the stationary barrel 4 may expand inwardly. When this happens, the gap S between the two barrels 4 and 12 will be almost or completely lost, which may eventually make the rotary barrel 12 non-rotational.

An attempt to identify what causes such problems was made, and it has been found that when the lining layer 3 on the stationary barrel 4 should be expanding toward the metallic wall 1 of the stationary barrel 4, the expansion will be prevented by the metallic wall 1, and will instead go toward the center of the stationary barrel 4 (that is, in the direction of narrowing the gap between the stationary barrel 4 and the rotary barrel 12).

The inventors of the current application proposed to provide a stationary barrel 4 in their prior invention (as filed under U.S. patent application No. 08/806,623 corresponding to EP 0791430 A1) that includes a continuously foamed neoprene rubber plate 2 first mounted on the inner side of the metallic wall 1 and a polyurethane lining layer 3 then formed thereon (FIG. 9), thereby allowing the lining layer 3 to expand flexibly outwardly.

In the above invention, a stationary barrel 4 including an air layer 5 in place of the neoprene rubber plate 2 was also proposed (FIG. 10).

Although good results were actually provided by the before mentioned stationary barrel 4 including the neoprene rubber plate 2, it was discovered that the neoprene rubber plate 2 must be thicker, e.g., about 6 mm thick, in order to reduce the resistance against the deformation of lining layer 3 when the lining layer 3 expands flexibly. It was also found that as the neoprene rubber plate 2 becomes thicker, the lining layer 3 must be the thinner.

For the before mentioned stationary barrel 4 including the air layer 5, there is no problem with the thickness that occurs for the neoprene rubber plate 2, but a mold must be provided for forming the air layer 5, and non-compressed fluid such as water must go in and out so that the mold material can be prevented from deforming at the time of liquid injection of the lining. This increases the overall cost.

SUMMARY OF THE INVENTION

In light of the above problems, and to solve them, the present invention provides a spiralflow barrel machine having a stationary barrel and a rotary barrel, wherein means is provided for detaching the lining layer, the detaching means extending over specific upper and lower areas of the metallic wall of the stationary barrel corresponding to the position of the small gap between the stationary and rotary barrels, and a small air layer (escape layer) is provided between the inner surface of the metallic wall of the stationary barrel and the outer surface of the lining layer formed on the metallic wall of the stationary barrel in the usual manner after the before described detaching means is provided. The small gap clearance between the stationary and rotary barrels may be adjusted by communicating the small air layer (escape layer) to the atmosphere for allowing the lining layer to be flexible. Alternatively, the small gap clearance may be adjusted by varying the internal pressure within the small air layer (escape layer). To make the formation of the air layer (escape layer) easier, it may be provided so as to extend from the middle portion of the stationary barrel to its bottom end.

One object of the present invention is therefore to provide a spiral-flow barrel finishing machine having a cylindrical stationary barrel and a rotary barrel closed at the bottom thereof, wherein it includes a gap adjusting function in the form of an escape layer extending over a specific area between the inner side of the metallic wall of the stationary barrel and the outer side of the lining layer formed thereon.

Another object of the present invention is to provide a spiral-flow barrel finishing machine having a cylindrical stationary barrel and a rotary barrel closed at the bottom thereof, wherein it includes a gap adjusting function in the form of an escape layer formed between the inner side of the metallic wall of the stationary barrel corresponding to the position of the gap between the stationary barrel and the rotary barrel opposite it and the outer wall of a lining layer formed on the metallic wall of the stationary barrel and extending over the outer bottom surface of the lining layer, allowing for expansion of the lining layer.

The before described escape layer is provided to allow for expansion of the lining layer wherein it is an air layer open at the bottom or a sponge layer.

Alternatively, the another construction may be used wherein the metallic wall includes a projection on its inner side located at the bottom end of the stationary barrel and in the neighborhood of the top of the before described escape layer, the projection extending into the lining layer and being buried therein.

A further object of the present invention is to provide a method of forming an escape layer on a spiral-flow barrel finishing machine having a cylindrical stationary barrel and a rotary barrel wherein it includes providing means for detaching a lining layer to be formed on the metallic wall of the stationary barrel. The detaching means is provided on the inner side of the metallic wall of the stationary barrel and extends over a specific area from upper and lower portions thereof corresponding to the position of the small gap between the stationary and rotary barrels, forming the above-mentioned lining layer on the inner side of the metallic wall of the stationary barrel, and forming an escape layer at the location where the detaching means was provided.

A mold release may be used as the before described detaching means, so that the escape layer is formed by contraction when the lining formed is allowed to harden.

Still another object of the present invention is to provide an escape layer in the form of an air layer that communicates to the atmosphere.

A further object of the present invention is to provide a method of forming an escape layer on a spiral-flow barrel finishing machine having a cylindrical stationary barrel and a rotary barrel closed at the bottom thereof, including providing means for detaching a lining layer to be formed on the metallic wall of the stationary barrel and including a mold release. The mold release extends over a specific area between the middle portion of the inner side of the metallic wall of the stationary barrel and the bottom end of the stationary barrel, and forms the above-mentioned lining layer in the usual manner. A further object of the present invention is to provide a method of forming an escape layer on a spiral-flow barrel finishing machine wherein it includes providing an escape layer molding means at the bottom end on the inner side of the metallic wall of stationary barrel, and forming a lining layer in the usual manner.

Another object of the present invention is to provide a method of adjusting a gap between a stationary barrel and a rotary barrel on a spiral-flow barrel finishing machine, wherein it includes adjusting the internal pressure in the before described escape layer between the inner side of the metallic wall of the stationary barrel and the outer side of the lining layer formed thereon, thereby adjusting the gap.

As described, the detaching means may include a mold release, specifically silicone resin or fluororesin, that may be sprayed or blown. It is noted, however, that any mold release that is known may also be used. The important consideration is that when a lining material, such as polyurethane, is surface processed, it should be easily detached from the metallic wall of the stationary barrel without permanently adhering to the metallic wall, or may be easily detached when it becomes hard by contraction. It should be noted that the part of the lining layer not facing the escape layer should remain attached tightly to the metallic wall. It is therefore preferable that the metallic wall is pre-processed (such as to present a rough surface or to include a binder).

The present invention includes a spiral-flow finishing barrel finishing machine that includes an escape layer (air layer) extending over a specific area between the inner side of the metallic wall of the stationary barrel and the outer side of the lining layer formed thereon. The present invention also includes a spiral-flow barrel finishing machine having a cylindrical stationary barrel and a rotary barrel wherein means for detaching a lining layer to be formed on the metallic wall of the stationary barrel is provided on the inner side of the metallic wall of the stationary barrel facing the small gap between the stationary and rotary barrels and extending over a specific area between upper and lower portions. The above-mentioned lining layer is formed, and an escape layer is provided between the inner side of the metallic wall and the outer side of the lining layer at the location where the detaching means was provided contraction when the lining layer becomes hard. In addition, the present invention includes a method of forming an escape layer (air layer) on the stationary barrel, and also includes a method of adjusting the small gap between the stationary and rotary barrels by adjusting the internal pressure in the escape layer.

The escape layer (air layer) may be provided, starting with the bottom end of the stationary barrel and extending to a specific height.

The machine can be running without any problem if the small gap S between the stationary and rotary barrels is set to the minimum value as long as it does not affect the rotation of the rotary barrel, and the small gap S may be adjusted by adjusting the internal pressure of the escape layer (air layer).

The method according to the present invention allows the air layer to be formed simply by applying a coating of mold release onto the particular part of the stationary barrel and then by taking advantage of the volume contraction when the lining material hardens. Thus, the air layer may be obtained more economically, precisely and automatically than with the conventional method.

The air layer that is provided internally allows for the outward thermal expansion of the lining layer 3. The air layer may be about 1 mm in width, which may still provide the performance reliably. Thus, the lining layer 3 may be thicker. The result is to make the life of the barrels longer.

BRIEF DESCRIPTION OF THE DRAWINGS

FIG. 2 (*b*) is a similar view to FIG. 1, showing the metallic wall already pre-processed;

FIG. 2 (*c*) is a similar view to FIG. 1, showing the metallic wall having a coating of any mold release;

DESCRIPTION OF THE PREFERRED EMBODIMENTS

Figure 1:
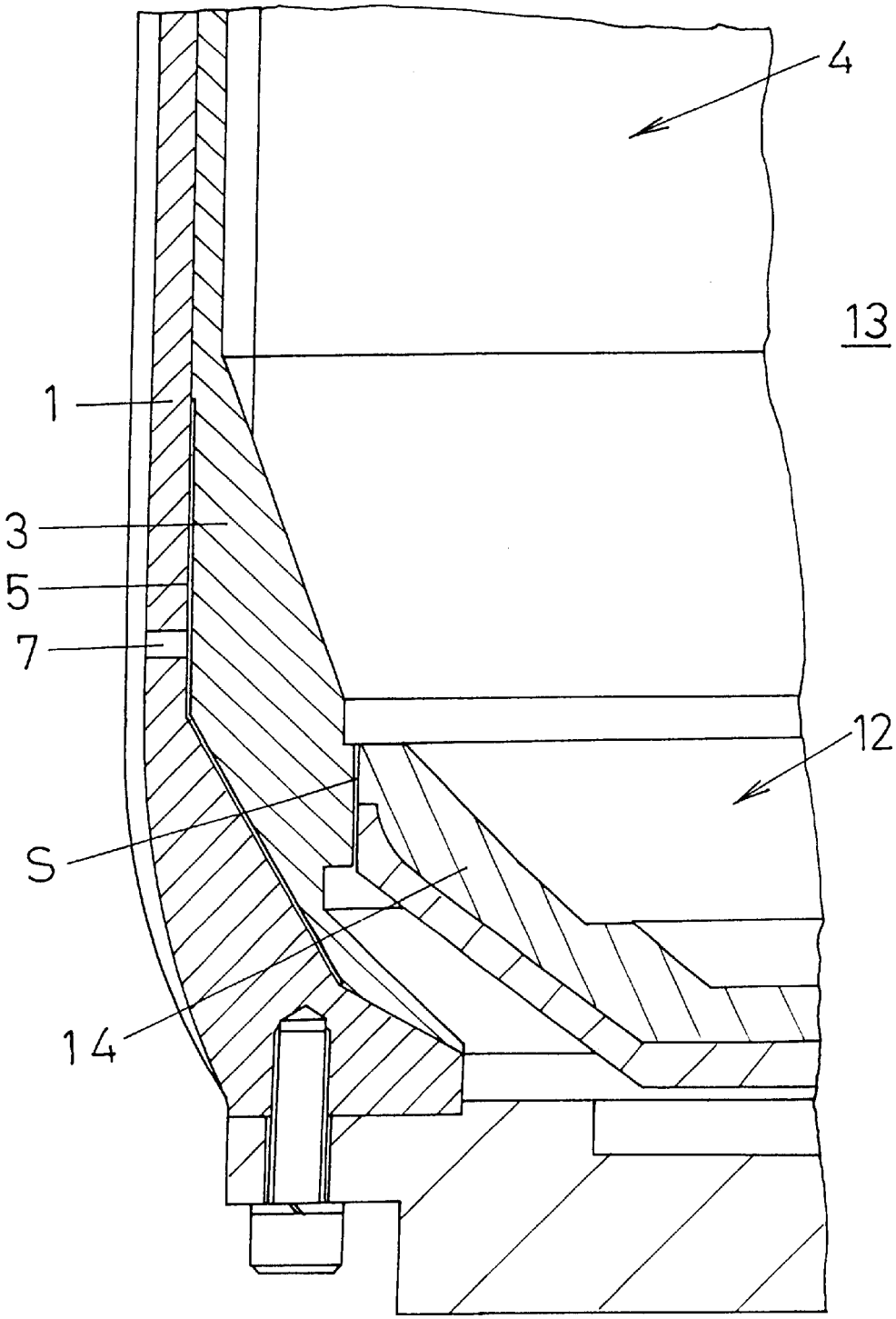
FIG. 1 is a partly enlarged cross sectional view of a spiral-flow barrel finishing machine that includes the features according to the present invention.
Figure 2A:
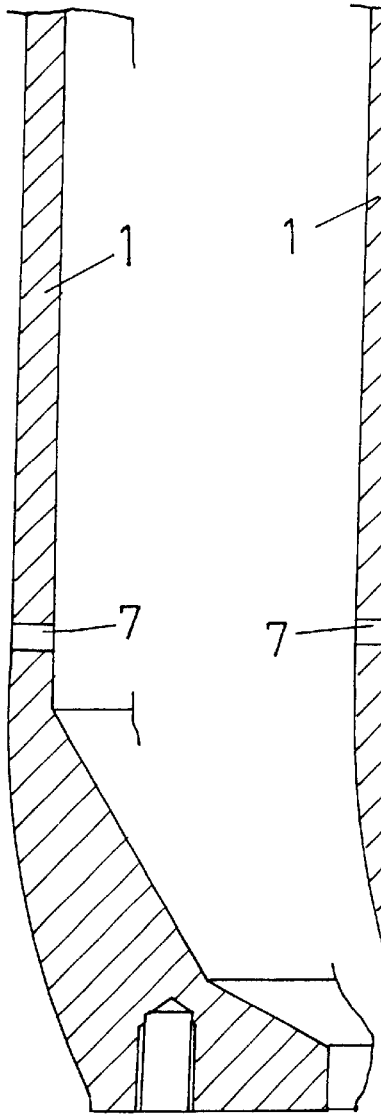
FIG. 2 (*a*) is a similar view to FIG. 1, showing a metallic wall that is not yet pre-processed.
Figure 2B:
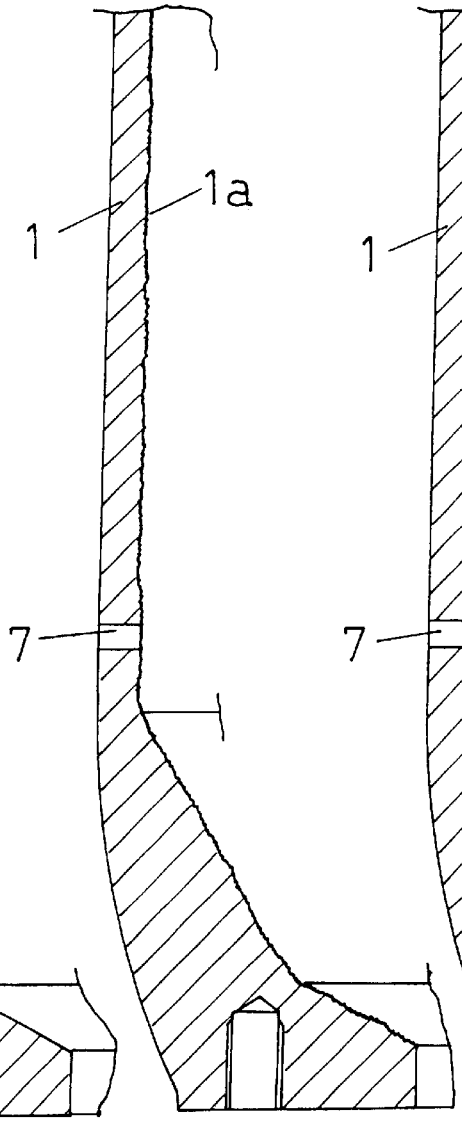
Figure 2C:
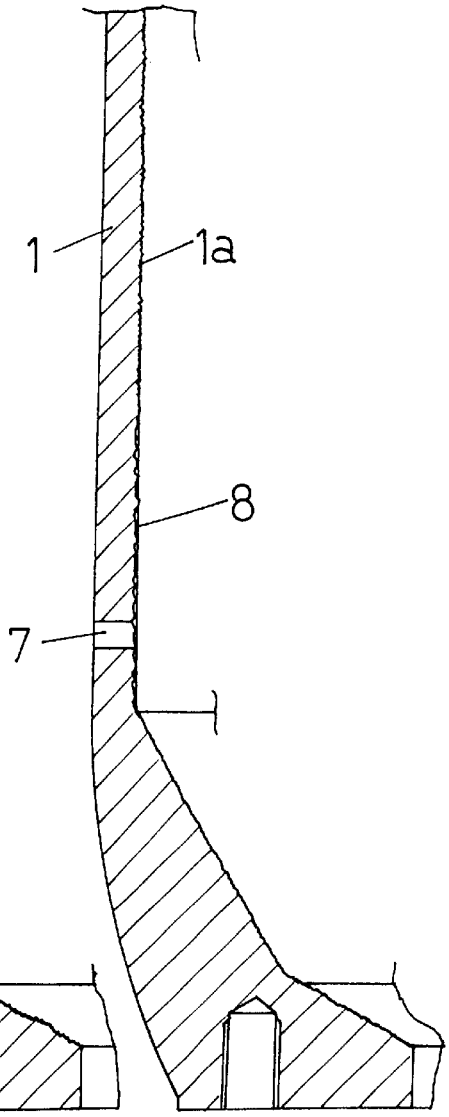
Figure 3:
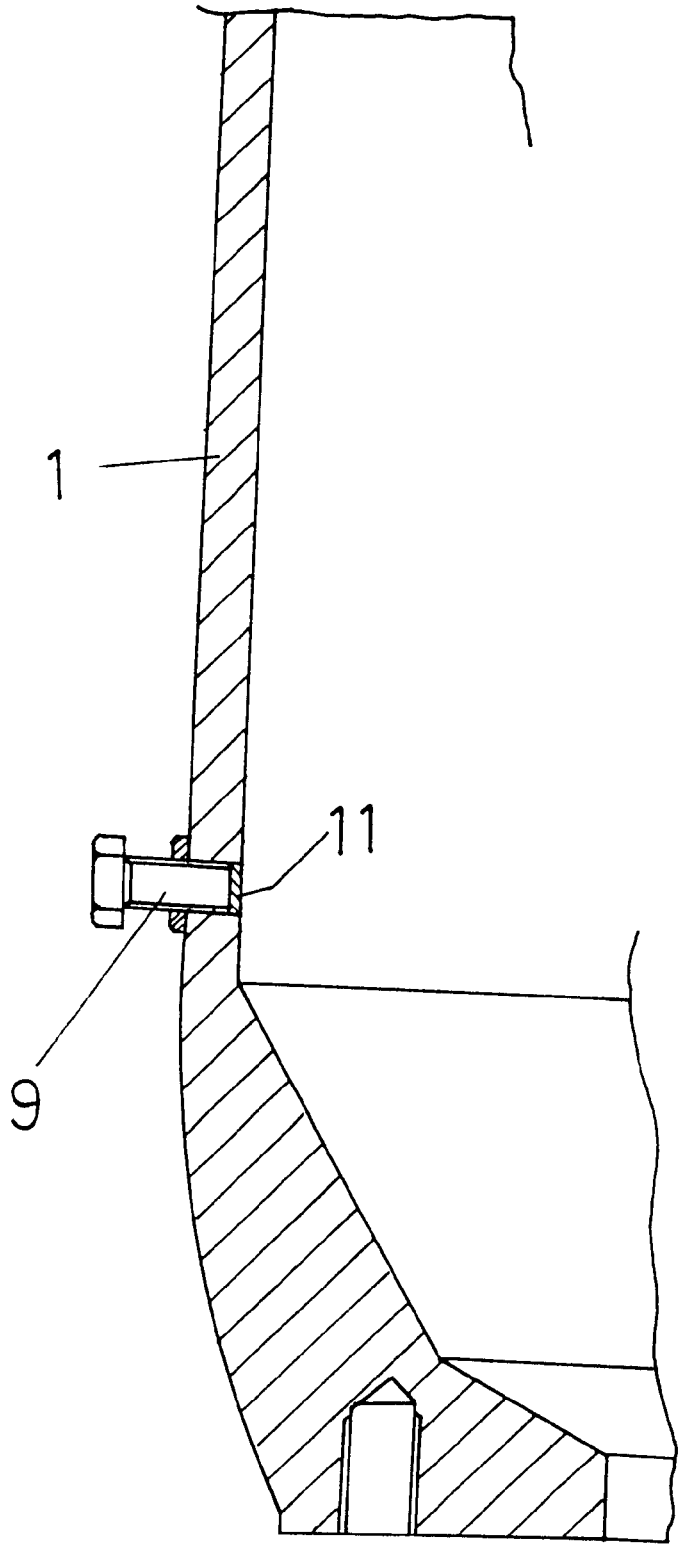
FIG. 3 is a similar view to FIG. 1, showing that an exhaust hole on a stationary barrel is closed.

Now, the present invention is described by referring to a particular embodiment shown in FIGS. 1, 2, and 3.

Before a lining layer 3 is provided on a inner side of the metallic wall 1 of the stationary barrel 4, the entire inner side of the metallic wall 1 is processed by blasting fine alumina powder thereonto, thereby making it a rough surface 1*a* (FIG. 2 (*b*)). This blast processing is required to prevent any areas of the lining layer 3 not coated by mold release 8 from being detached when the lining layer 3 contracts and the coated area of the lining layer 3 is detached by itself from the inner side of the metallic wall 1. It is also required to increase the bonding strength between the metallic wall 1 and lining layer 3. In some cases, a coupling medium may be applied to other areas of the rough surface 1*a* than those coated by the mold release to further increase the bonding strength between the metallic wall 1 and lining layer 3.

When the blast process is completed, a bolt 9 is plugged into an air outlet hole 7 to prevent raw lining resin liquid from leaking through the air outlet hole 7. Then, the raw lining resin liquid is ready to be injected into the mold. The head of the bolt 9 is previously caulked with silicone 11 both for the purpose of preventing the raw lining resin liquid from leaking through the threads of the bolt 9 and for the purpose of preventing the raw lining resin and bolt 9 from attaching to each other (FIG. 3).

A coating of mold release 8 is applied around the area of the inner side of the metallic wall 1 facing the small gap S between the stationary barrel 4 and a rotary barrel 12 opposite to it, and at a height of about 100 mm (FIG. 2 (*c*)). This is made for detaching the lining layer 3. When this is finished, the raw lining resin liquid may be injected into the mold. Before it, a core (not shown) is provided. This core has the pattern that conforms to the lining layer form, and is set. After the core is set, it may be caulked by silicone 11, if necessary, to prevent leaks of the raw lining resin when it is injected. Finally, the raw lining resin liquid (e.g., raw polyurethane resin liquid) is injected.

The raw polyurethane resin usually includes a major part of polyurethane and a hardener. Before mixing and injecting, they are defoamed (evacuated) to prevent any air bubbles from entering the lining layer 3 being formed.

After injection, the raw polyurethane resin liquid is allowed to set for a specific period of time. When it is beginning to harden and contract to some degree, the core is removed, and the bolt 9 is then removed from air outlet hole 7. It is noted that if the bolt 9 is removed at the moment that the polyurethane contracts and an air layer 5 is beginning to be formed, the air layer 5 will be exposed to the atmosphere, and the polyurethane resin will contract more quickly than if it is placed under vacuum. Thus, a thicker air layer 5 (escape layer) can be obtained.

When the polyurethane resin has completely hardened, it becomes the lining layer 3. The part of the lining layer coated by the mold release 8 will contract itself and be detached from the inner side of the metallic wall 1. The remaining part becomes the air layer 5 having the height of 100 mm and width of 1 mm, extending between the inner side of the metallic wall 1 and the outer side of the lining layer 3. It is noted that it is better to leave the lining layer 3 for a specific time until it is completely cured, after it has completely hardened. Instead of polyurethane resin, other resins such as polyester resin, vinyl chloride resin and the like may be used.

The air layer 5 is about 1 mm wide, but it may be wide enough to allow for the outward expansion of the lining layer 3 on the metallic wall 1. If it is too large, the lining layer 3 might be deformed abnormally. The dimensions of the air layer 5 may be adjusted by varying the contracting rate of the lining resin at the time of hardening, its hardness after hardening, and the height of the air layer 5 (the width at the upper and lower portions being coated by mold release), as appropriate. When this adjustment is made, the amount of expansion should be equal to that for the lining layer 14 on the rotary barrel 12.

A spiral-flow barrel finishing machine 13 may be completed by combining the stationary barrel 4 thus obtained with the rotary barrel 12, with an adequate small gap S there between.

Figure 4:
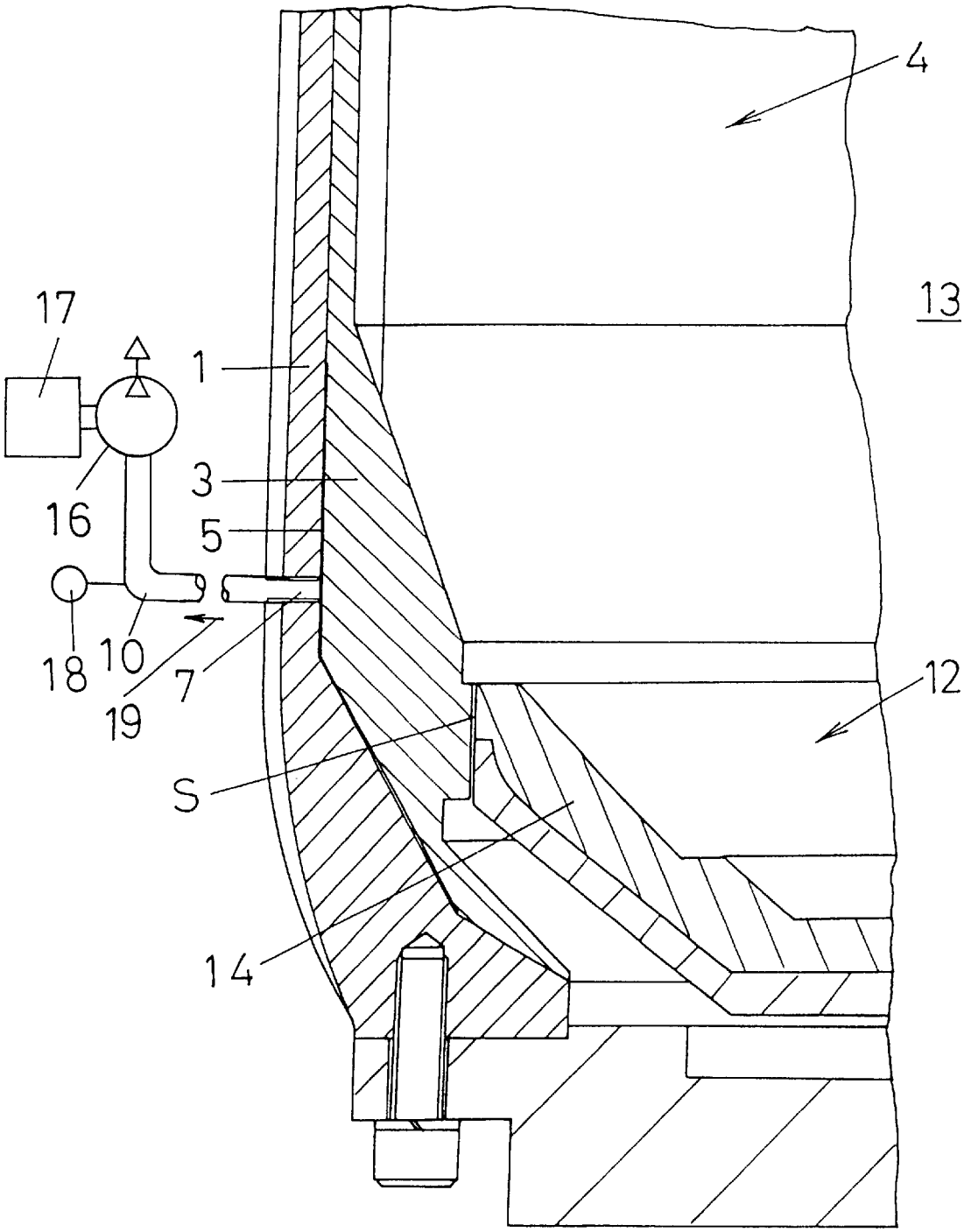
FIG. 4 is an illustrative view showing a method of adjusting a small gap according to the present invention.

Referring next to FIG. 4, a method of adjusting the small gap S between the stationary barrel and the rotary barrel according to the present invention is described. As shown in FIG. 4, a suction pipe 10 from a vacuum pump 16 is connected with the air outlet hole 7 on the stationary barrel 4 on a spiral-flow barrel finishing machine 13. In FIG. 4, there are also a motor 17 and a pressure gauge 18.

In operation, the motor 17 is started up, and the vacuum pump 16 is then running. Air is then removed from the air layer 5, placing it under the reduced pressure (such as 0.08 Mpa). Under the reduced pressure, the lining layer 3 is attracted toward the metallic wall 1 of the stationary barrel, widening the small gap S. Any work chips and/or worn abrasive media particles that remain in the gap may be removed therefrom. For the dry work finishing using the spiral-flow barrel finishing machine, any chips or worn abrasive particles may be collected from the bottom through the gap. This may be accomplished more effectively by using the above method.

When dirty water is removed at the end of the finishing operation, it cannot be removed quickly because the gap is normally small. By adjusting the gap to be wider, such as 1 mm as practiced by the conventional machine, the dirty water can be forced out, and its preparatory work can be accomplished in a shorter time. The vacuum pump may be coupled with a compressor pump, in which case the pressure may be increased as required, making the gap much narrower.

The pressure gauge 18 may be coupled with a controller (not shown) which provides output for controlling the motor 17 so that the pressure in the air layer 5 may be controlled automatically.

The following presents the results of the experiment that took place by using the spiral-flow barrel finishing machine 13 as shown in FIG. 1 (Tipton Co.'s Type EFF-40, barrel capacity of 40 liters). Abrasive media, water, compound, and works piece being processed (which will be referred collectively to as "mass") are provided in appropriate quantities, respectively.

Figure 11:
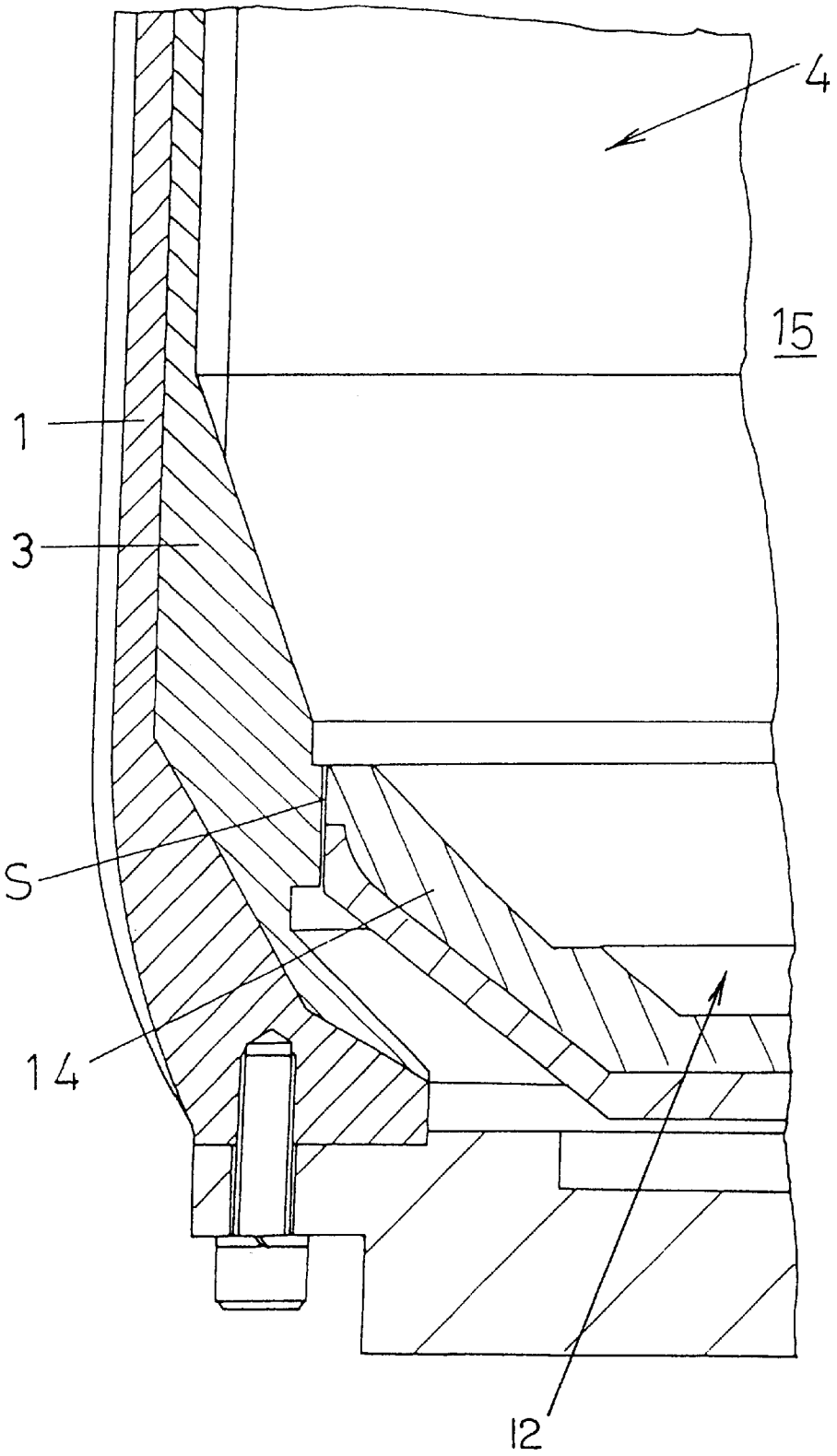
FIG. 11 (Prior Art)
FIG. 11 is a partly enlarged cross sectional view of a conventional spiral-flow barrel finishing machine.

The machine 13 was operated with the small gap S between the stationary and rotary barrels initially set to 0.3 mm. It is noted that for the conventional machine 15 (FIG. 11), the gap S must be set to 1 mm. The reason is that if the gap S is smaller than 1 mm, the rotary barrel 12 might become non-rotational within a short time (about 30 minutes), and if the gap S is larger than 1 mm, works pieces and abrasive media might easily be engaged by the gap S. Thus, the usable gap width is limited in the conventional machine.

The machine 13 was running for one hour. At the end of one hour, the temperature of the mass within the barrel rose to about 60° C.

For the conventional machine 15 with no air layer 5, it was found that the lining layer 14 on the rotary barrel 12 expanded thermally outwardly, and the lining layer 3 on the stationary barrel 4 expanded thermally inwardly. Thus, there was practically no gap left. Eventually, the rotary barrel 12 became non-rotational in some cases.

For the inventive machine 13, as the air layer 5 is provided between the inner side of the metallic wall 1 and the outer side of the lining layer 3, the lining layer 14 on the rotary barrel 12 expands thermally outwardly while the lining layer 3 on the stationary barrel 4 opposite the lining layer 14 also expands thermally outwardly (toward to the inner side of the metallic wall 1), which keeps the gap S constant. Thus, the rotary barrel 12 cannot be non-rotational.

When thermal expansion occurs, the air layer 5 may be placed under the higher pressure since the lining layer 3 expands to the inner side of the wall 1 so as to decrease the space of air layer 5, but the pressure may be reduced by releasing the air therein through the air outlet hole 7. Thus, the lining layer 3 on the stationary barrel 4 may expand thermally flexibly and without any problem.

It may be appreciated that the gap S may be kept constant in response to any change in the temperature within the machine. Thus, the gap S can be set to the minimum required width. Very small works piece, thin works piece, and very small abrasive media that cannot be handled with the present invention by the conventional machine can be handled because they will not be engaged by the gap S between the stationary barrel and the rotary barrel.

Figure 5:
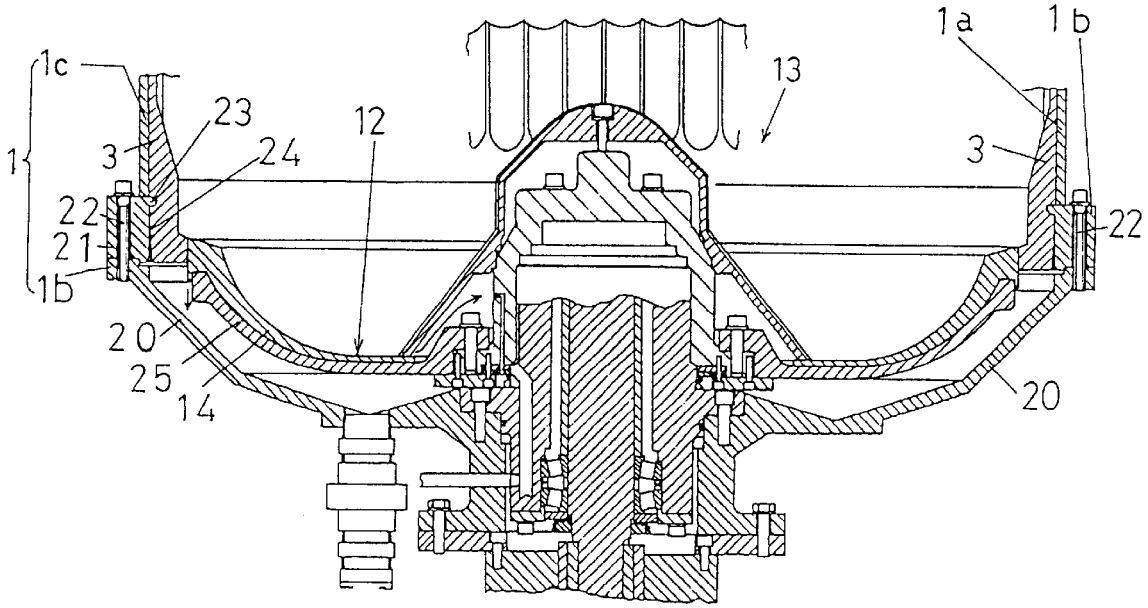
FIG. 5 is a cross sectional view of another embodiment of the present invention.
Figure 6:
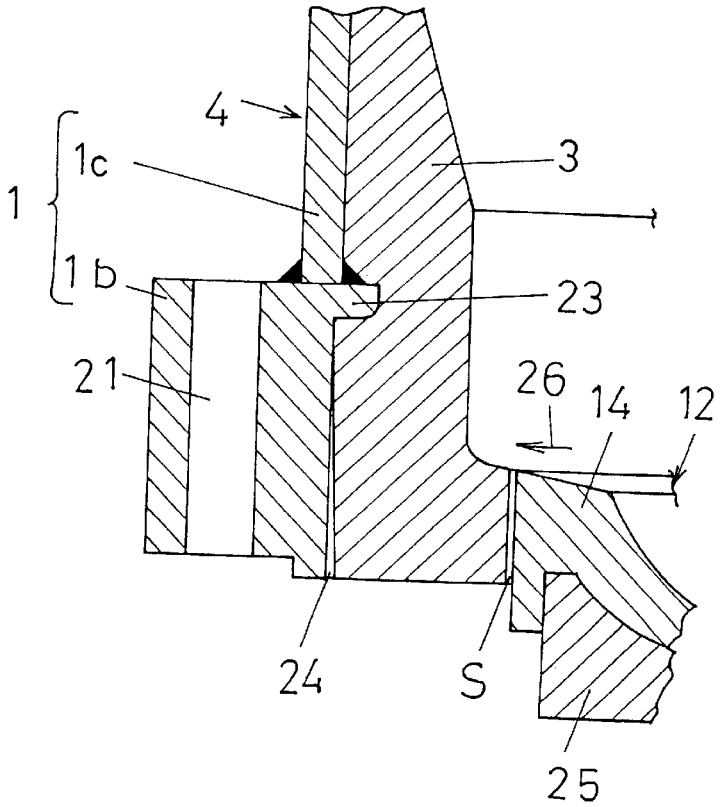
FIG. 6 is a partly enlarged cross sectional view of FIG. 5.

Referring next to FIGS. 5 and 6, other embodiments of the present invention are described below. The cylindrical stationary barrel 4 has a metallic wall 1 formed by joining contact points of an upper metallic wall portion 1*c* and a lower metallic wall portion 1*b* by soldering, and by forming a common lining layer 3 on the inner side of the joined upper and lower metallic wall portions 1*c* and 1*b*. The lower metallic wall portion 1*b* has bolt holes 21 around the outer periphery of the bottom, which are used to fasten the stationary barrel 4 to an outer bottom 20. The bottom of the stationary barrel 4 and the outer bottom 20 may be fastened by inserting bolts 22 into the corresponding bolt holes 21. The lower metallic wall portion lb has an annular flange (projection) 23 at an upper inner side extending inwardly, and the annular flange 23 is buried (embedded) in the lining layer 3, and fastens the lining layer 3 and the lower metallic wall portion 1*b*. When a lining layer 3 is formed on the inner side of the lower metallic wall portion 1*b*, a coating of mold release has been applied on the surface of the lower metallic wall portion 1*b* below the annular flange 23, so that the outer side of the lining layer 3 and the inner side of the lower metallic wall portion 1*b* may be easily detached when the lining layer 3 hardens and contracts. An air layer 24 (escape layer) may thus be formed. The mold release may be silicone, for example.

To form the lining layer 3, a core (not shown) having the pattern that conforms to the particular shape of the lining layer 3 is set so that the raw lining resin liquid (for example, raw polyurethane resin) can form the lining layer 3 of that shape on the inner side of the metallic wall 1 when it is injected between the metallic wall 1 and the core. In this case, the raw lining resin liquid may include a major part of polyurethane and a hardener. They are mixed by stirring, and then injected. Prior to stirring, air bubbles may be removed (pressure reduced) so that air bubbles are prevented from entering the lining layer 3.

After being injected, the raw lining resin is allowed to harden completely for a certain time, and then the core is removed. The polyurethane resin hardens to form the lining layer 3. In this case, the part of the lining layer coated by the mold release hardens and contracts (volume contracted), and the air layer 24 is formed automatically.

The rotary barrel 12 is disposed rotatably within the stationary barrel 4 on its lower side, and the rotary barrel 12 has a lining layer 14 formed on metallic bottom plate 25, with the outer peripheral wall of the lining layer 14 being spaced away from the lower inner wall of the lining layer 3 on the stationary barrel 4 opposite to it. This spacing corresponds to the small gap S (FIG. 6).

When the machine 13 is running, the lining layers 3, 14 may expand thermally. In this case, the lining layer 3 retracts by the action of the air layer 24, and the lining layers 3, 14 expand in the same direction (shown by arrow 26) (FIG. 6). As the lining layer 3 can retract, the small gap S will not become smaller. Thus, the rotary barrel 12 cannot be non-rotational.

The small gap S can be minimized as long as it does not affect the rotation of the rotary barrel 12. Thus, very thin works piece or very small abrasive media will not be engaged by the small gap S. The machine operation can thus be reliably.

The following presents the results of another experiment using the machine 13 as shown in FIGS. 5 and 6.

In operation, abrasive media, water, compound, and works piece being processed are provided in appropriate quantities, respectively, and are placed into the spiral-flow barrel finishing machine 13 (Tipton Co.'s EFF-205, barrel capacity of 200 liters). The height of the small gap S is initially set to 24 mm, and the height of the air layer 24 is initially set to 56 mm.

The gap S between the stationary barrel 4 and rotary barrel 12 opposite to it is initially set to 0.3 mm.

As in the preceding experiment, it has been found that the gap S can be kept constant, and the rotary barrel 12 cannot be non-rotational.

As the air layer 24 is open at the bottom as shown in FIG. 6, the performance can be achieved even if there is no space sufficient to accommodate the complete air layer (closed air layer) in the stationary barrel as in the preceding embodiments of FIGS. 1 to 4.

Any pressure upon the air layer can be released from its bottom, and the air outlet hole 7 may be eliminated. Thus, the manufacturing cost can be saved comparing with the preceding embodiments of FIGS. 1 to 4.

The annular flange 23 on the inner side of the metallic wall 1*b* prevents the lining layer 3 from contracting vertically. Thus, detachment of any extra lining layer 3 is avoided.

Figure 7:
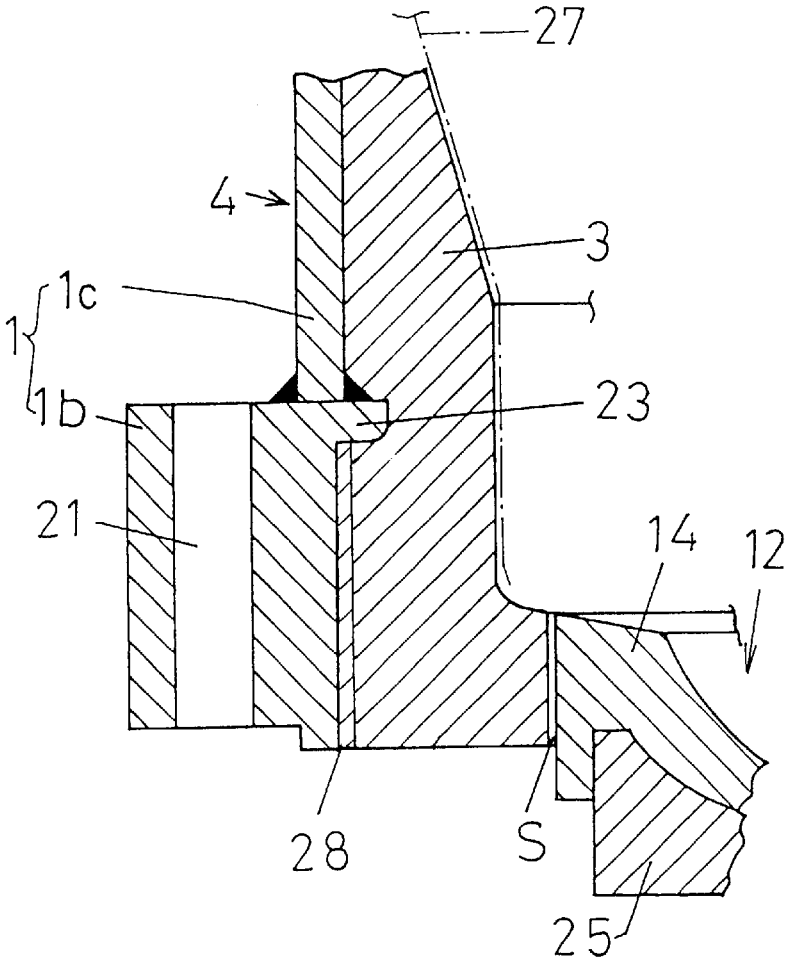
FIG. 7 is a partly enlarged cross sectional view of a further embodiment of the present invention.
Figure 8:
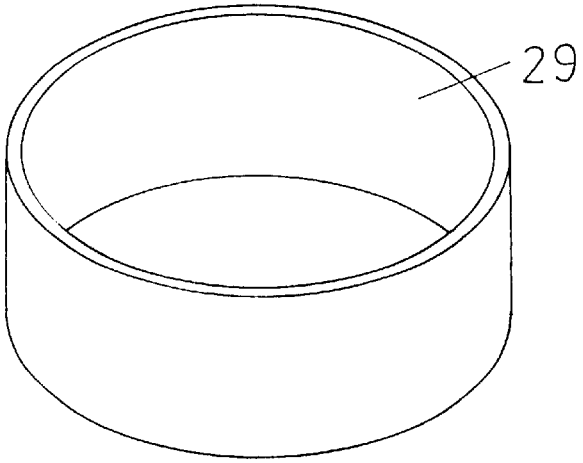
FIG. 8 is a perspective view of a ring mold.
Figure 9:
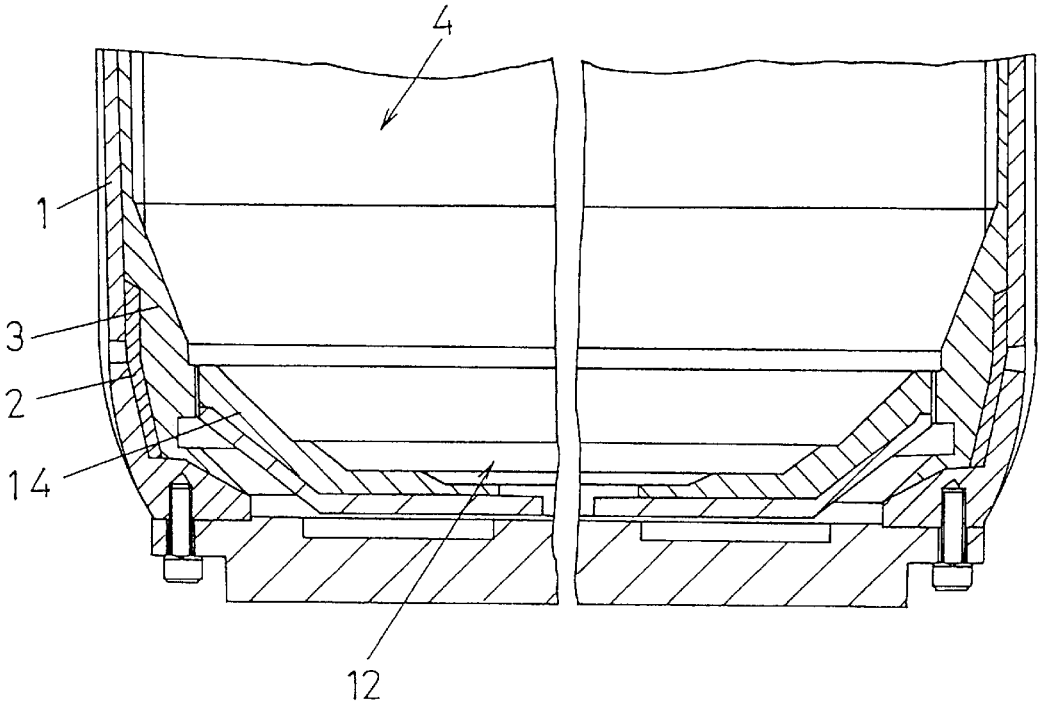
FIG. 9 (Prior Art)
FIG. 9 is a partly enlarged cross sectional view of the stationary barrel construction using a neoprene rubber plate, as disclosed in the current inventor's prior application.
Figure 10:
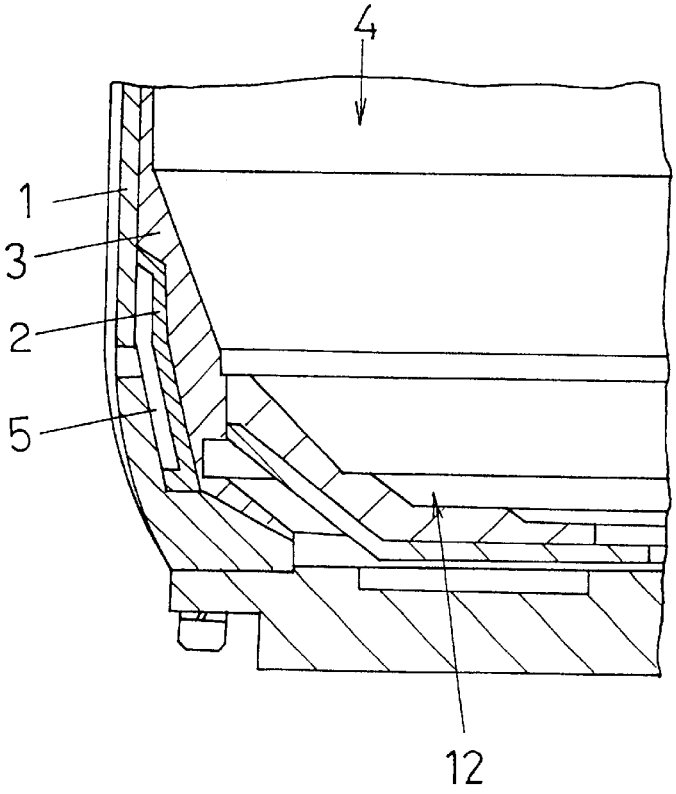
FIG. 10 (Prior Art)
FIG. 10 is a similar view to FIG. 9 using a air layer.

Referring next to FIGS. 7 and 8, other embodiments of the present invention are described. A ring mold 29 for forming an air layer (escape layer) 28 is fitted at the bottom within the metallic wall 1 of the stationary barrel 4, and a core 27 is then set. Then, a polyurethane resin liquid is injected into the gap between the inner side of the metallic wall 1 (the inner side of the ring mold 29) and the core 27, and is allowed to harden. After it has hardened, the ring mold 29 and core 27 are removed. The air layer (escape layer) 28 is thus obtained.

As the air layer (escape layer) 28 can be formed in the manner described above, the air layer (escape layer) 28 may be formed to have a cross section conforming to any desired shape, and the polyurethane resin liquid may be used without having to consider the particular requirements, such as the rate of hardening and contracting. This means that any resin that will not harden and contract (such as a cold setting polyurethane resin) may be used.

Although the present invention has been described by showing the particular embodiments thereof, it should be understood that various changes and modifications may be made without departing from the spirit and scope of the invention.

What is claimed is:

1. A spiral-flow barrel finishing machine, comprising:

a cylindrical stationary barrel having a metallic wall with an inner side and a lining layer formed on the inner side of said metallic wall, said lining layer having an outer side with an outer surface and a bottom;

a rotary barrel;

a gap between said rotary barrel and said stationary barrel; and an escape layer extending between said inner side of said metallic wall of said stationary barrel, facing said gap between said stationary barrel and said rotary barrel, and said outer side of said lining layer;

wherein said escape layer extends over said outer surface of said lining layer at said bottom of said lining layer to allow thermal expansion of said lining layer; and wherein said escape layer comprises an air layer open at a bottom of said escape layer.

2. The spiral-flow barrel finishing machine of claim 1, and further comprising a projection at a bottom of said stationary barrel on said inner side of said metallic wall adjacent to a top of said escape layer, said projection extending into said lining layer and being embedded therein.

3. A spiral-flow barrel finishing machine, comprising:

a cylindrical stationary barrel having a metallic wall with an inner side and a lining layer formed on the inner side of said metallic wall, said lining layer having an outer side with an outer surface and a bottom;

a rotary barrel;

a gap between said rotary barrel and said stationary barrel; and an escape layer extending between said inner side of said metallic wall of said stationary barrel, facing said gap between said stationary barrel and said rotary barrel, and said outer side of said lining layer, wherein said escape layer extends over said outer surface of said lining layer at said bottom of said lining layer to allow thermal expansion of said lining layer; and a projection at a bottom of said stationary barrel on said inner side of said metallic wall adjacent to a top of said escape layer, said projection extending into said lining layer and being embedded therein.

* * * * *